United States Patent [19]

Archer et al.

[11] Patent Number: 4,875,875

[45] Date of Patent: Oct. 24, 1989

[54] FIELD TERMINABLE MODULAR CONNECTOR

[75] Inventors: Lee A. Archer, Asheville; Kenneth W. Brownell, Jr., Marion, both of N.C.

[73] Assignee: Brintec Corporation, Williamantic, Conn.

[21] Appl. No.: 101,570

[22] Filed: Sep. 28, 1987

[51] Int. Cl.[4] ..... H01R 4/24

[52] U.S. Cl. ..... 439/401; 439/456; 439/465; 439/676

[58] Field of Search ..... 439/389–414, 439/417, 418, 419, 422, 443, 452, 453, 456, 459, 465, 695, 696, 709, 712, 676

[56] References Cited

U.S. PATENT DOCUMENTS

| | | | |
|---|---|---|---|
| 2,673,968 | 3/1954 | Smith | 439/417 |
| 2,802,083 | 8/1957 | Lapeyre | 439/409 |
| 3,596,232 | 7/1974 | Medley | 339/99 |
| 3,708,779 | 1/1973 | Enright et al. | 339/99 R |
| 4,023,879 | 5/1977 | Braund et al. | 439/465 |
| 4,109,991 | 8/1978 | Evans | 339/99 R |
| 4,194,803 | 2/1980 | Hatch | 339/99 R |
| 4,195,898 | 1/1980 | Chow et al. | 339/99 R |
| 4,444,448 | 4/1984 | Silbernagel et al. | 339/98 |
| 4,444,449 | 4/1984 | Aysta et al. | 339/99 R |
| 4,444,474 | 4/1984 | Markwardt | 339/98 |
| 4,496,206 | 1/1985 | Markwardt et al. | 339/98 |
| 4,522,459 | 6/1985 | Hardesty et al. | 339/98 |
| 4,545,635 | 10/1985 | Bunnell | 439/404 |
| 4,723,915 | 2/1988 | Gentry | 439/417 |

*Primary Examiner*—David Pirlot

*Attorney, Agent, or Firm*—McCormick, Paulding & Huber

[57] ABSTRACT

A modular connector for field termination of an electrical cable containing a plurality of individually insulated conductors and having a body, a contact carrier in snap-in assembly with the body and a cover assembly for snap-in assembly with the body in the field and including a cover and a cable strain relief member attached to the cover by a living hinge. The cable strain relief member is arranged for snap-in assembly with the body in the field. A stuffing member carried by the cover sets each conductor in an associated contact of IDC type mounted on the contact carrier as the cover is snapped into assembly with the body. A blade mounting on the contact carrier cooperates with a shearing member depending from the cover to trim the free ends of the conductor during cover assembly. Assembly of the cover with the body also applies strain relief to the cable and each of the conductors and also deflects the trimmed conductors away from the shearing blade.

24 Claims, 6 Drawing Sheets

FIELD TERMINABLE MODULAR CONNECTOR

BACKGROUND OF THE INVENTION

This invention relates in general to electrical connectors and deals more particularly with an improved field terminable modular connector.

Increasing service cost and cost savings incentives afforded users of telecommunication equipment who install and service their own inhouse systems has created an increasing demand for improved telecommunications accessories which may be installed by persons having ordinary skill. Further, current art generally requires that insulated conductors terminated by electrical contacts of IDC type be snipped or cut to proper length before final insulation displacement setting.

It is the general aim of the present invention to provide an improved modular connector assembly for installation in the field by a person of ordinary skill and which does not require special tools or equipment for installation. A further aim of the invention is to provide an improved field terminable modular connector assembly of IDC type for terminating a cable with a high degree of integrity and which does not require that the individual insulated conductors which comprise the cable be trimmed to predetermined length prior to termination.

SUMMARY OF THE INVENTION

In accordance with the present invention an improved field terminable modular connector comprises a plurality of connector sections which cooperate in assembly to form the connector, a plurality insulation displacement contacts mounted in fixed position on one of the sections, means defined by another of the sections for setting a plurality of insulated conductors in insulation displacing engagement with the contacts in response to movement of the other section into assembled relation to the one section, shearing means for trimming free end portions of the insulated conductors in spaced relation to the contacts in response to movement of the other section into assembled relation to the one section, and deflecting means for moving the trimmed end portions away from the shearing means in response to movement of the other housing section into assembled relation to one housing section.

DETAILED DESCRIPTION OF PREFERRED EMBODIMENT

Figure 6:
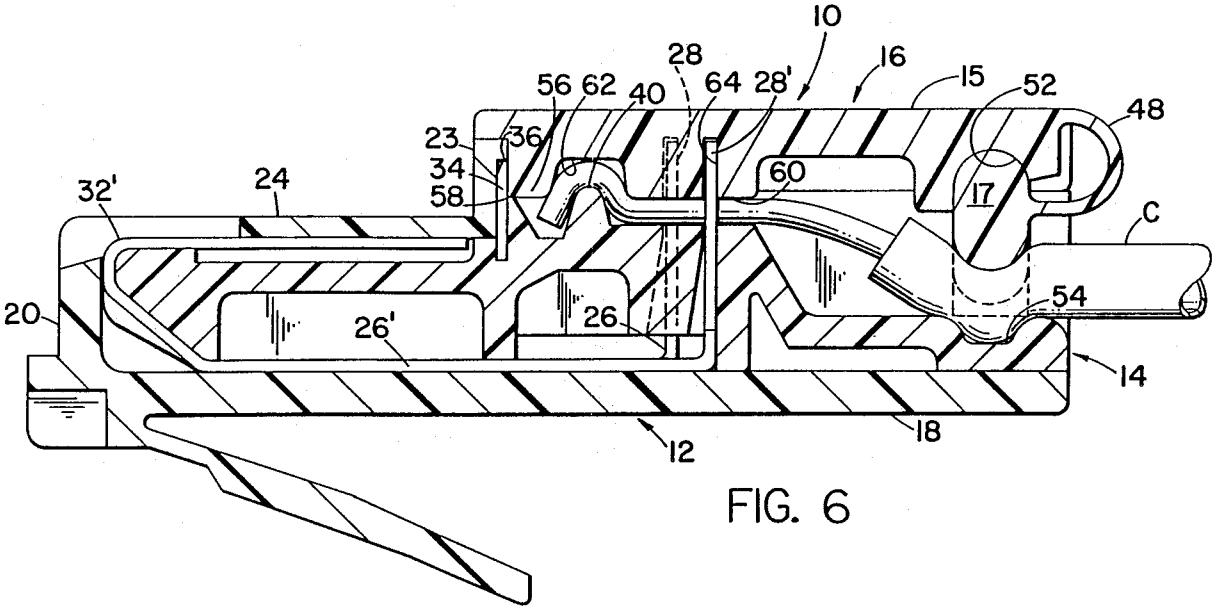
FIG. 6 is a sectional view taken generally along the line of 6—6 of FIG. 4.

Referring now to the drawings, a field terminable modular connector or plug embodying the present invention is indicated generally by the reference numeral 10. The illustrated connector 10 is an eight conductor line cord plug adapted to be received in mating engagement with a standard FCC telephone plug receptacle. It is particularly adapted to terminate an insulated electrical cable, such as a telecommunication cable containing eight individual solid wire conductors. Such a cable is shown in FIG. 6 and designated by the letter C. The connector is formed by a plurality of individual parts which cooperate during assembly in a manner which will be hereinafter more fully described.

The parts or sections which comprise the modular connector 10 are preferably molded from durable resilient dielectric plastic material and include a hollow body indicated generally at 12, an insert or contact carrier designated generally by the numeral 14 and received within the body, and a cover assembly indicated generally at 16, which includes a cover 15 and a strain relief member 17 and provides a closure for a top opening in the upper rear portion of the body 12 and strain relief for the cable C, as hereinafter further discussed.

Figure 1:
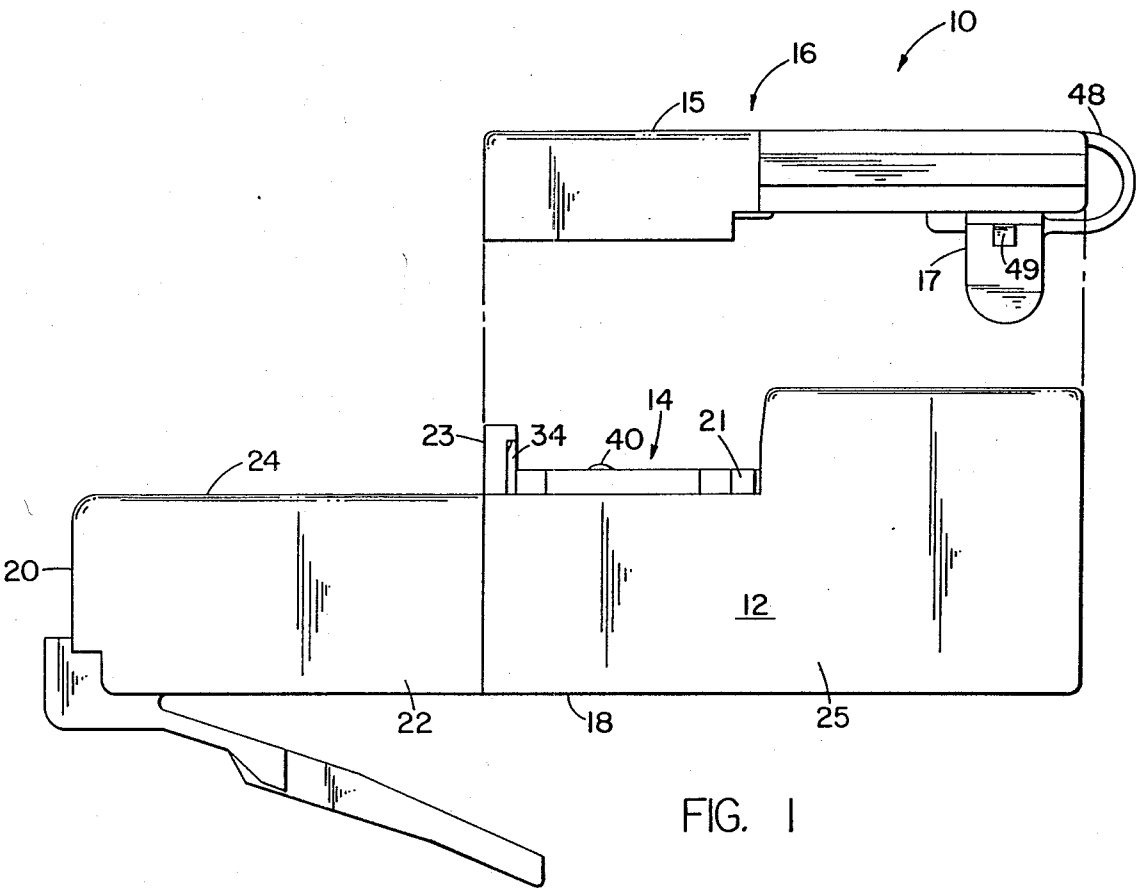
FIG. 1 is an exploded side elevational view of a field terminable modular plug embodying the present invention.
Figure 2:
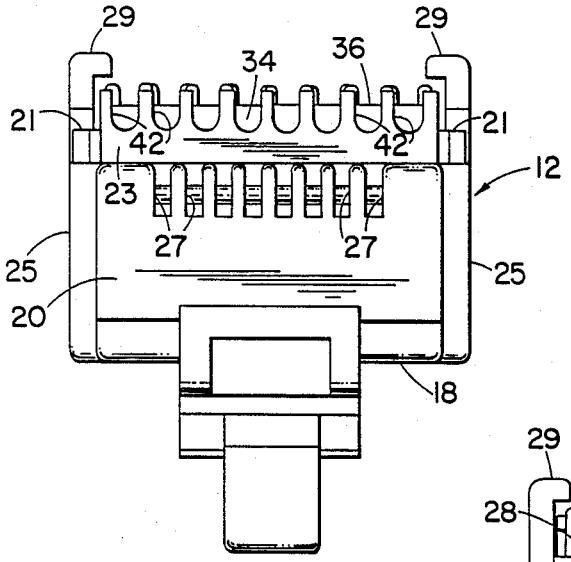
FIG. 2 is a front elevational view of the modular plug with the cover assembly removed therefrom.
Figure 5:
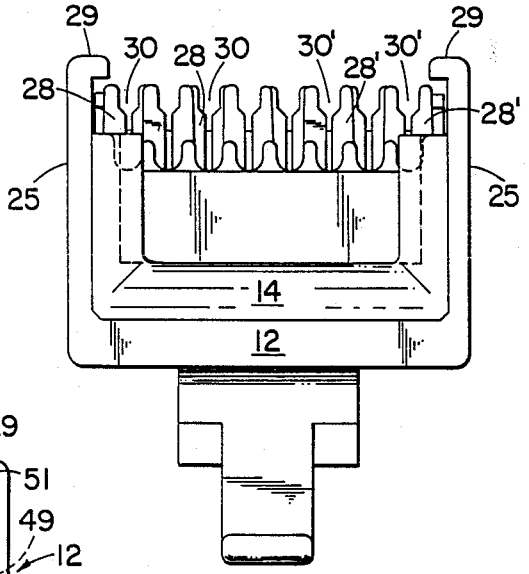
FIG. 5 is a rear elevational view of the modular plug shown with the cover assembly removed therefrom.
Figure 3:
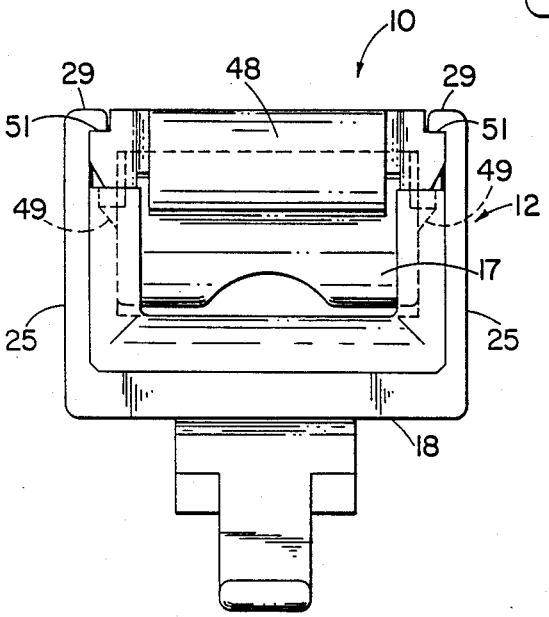
FIG. 3 is a rear elevational view of the modular plug.

As oriented in the drawings, the body section 12 has a plugging part at its forward end sized to be received in plugging engagement within a standard FCC telephone plug receptacle. The plugging part has a bottom wall 18, a front wall 20 and side walls 22,22 which extend upwardly from the bottom wall and a top wall 24 which extends rearwardly for some distance from the front wall and terminates approximate the central portion of the body at a transversely disposed and upwardly extending central wall 23. The body also has a conductor terminating part which is integrally connected to and extends rearwardly from the plugging part. The bottom wall of the conductor terminating part is formed by the rearward extension of the bottom wall 18. However, the conductor receiving part has a lateral width slightly greater than the lateral width of the plugging part and includes side walls 25,25. Preferably the width of the conductor terminating part is substantially equal to the width of the plugging part plus the combined major thickness of the two side walls 25,25. The body walls cooperate to define a rearwardly and upwardly open body cavity for receiving the contact carrier 14. A laterally spaced apart series of rearwardly extending slots 27,27 at the front end of the body, equal in number to the number of conductors to be terminated, open through the plugging part front and top walls 20 and 24 and communicate with the body cavity. A pair of opposing longitudinally extending lips 29,29 project laterally inwardly from the upper edges of the side walls 25,25 as shown in FIGS. 2–5. The lips 29,29 comprise hook-like projections as viewed from the ends of the modular plug 10 and as best shown in FIGS. 2, 3 and 5.

Figure 4:
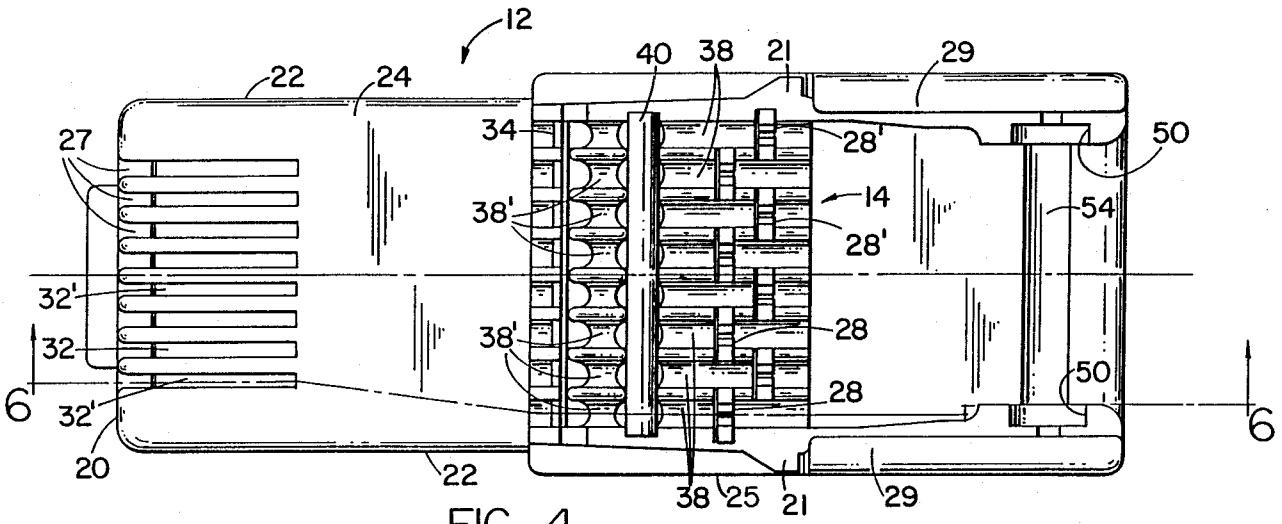
FIG. 4 is a plan view of the modular plug shown with the cover assembly removed therefrom.

The contact carrier 14 is configured to be slidably received within the body cavity and is retained in snap-together assembly with the resilient body section 12 by connecting elements 21,21 which project from opposite sides of the contact carrier 14, as shown in FIG. 4, and snap into engagement with upwardly extending and forwardly facing edges of the side walls 25,25. An array of longitudinally elongated resilient insulation displacement contacts, equal in number to the conductors to be terminated, are mounted on the front portion of the contact carrier 14. The contacts are preferably stamped from flat spring metal and include two groups of contacts, designated generally at 26,26 and 26',26', mounted in laterally spaced apart alternate series on the contact carrier. The contacts which comprise the two groups are of somewhat similar configuration, however the rear or insulation displacement portions of the various contacts, which portions are located within the conductor terminating part of the body 12, are laterally offset from the front portions thereof by varying amounts. It should also be noted that the contacts 26',26' are of somewhat greater longitudinal extent that the contacts 26,26.

A typical contact 26', best shown in FIG. 6, has a bifurcated insulation displacement portion 28' which extends through and projects above the contact carrier 14 and defines an upwardly open insulation displacement slot 30', best shown in FIG. 5. The illustrated contact 26' further includes a contact portion 32', of somewhat lesser lateral width than the insulation displacement portion 28', integrally connected to the lower end of the insulation displacement portion 28'. The contact portion 32' is disposed within a generally complementary groove in the contact carrier 14, extends in a forward direction along the underside of the contact carrier, is reversely bent about the forward end of the contact carrier, and extends rearwardly for some distance along the upper portion of the contact carrier, substantially as shown in FIG. 6. When the contact carrier 14 is assembled with the body 12 the contact portions 32 and 32' are exposed within associated slots 27,27 at the front end of the connector body 12.

The length differential between the contacts of the two groups cause the insulation displacement portions of the contacts which comprise the two groups to be longitudinally staggered, as viewed from above and best shown in FIG. 4. This arrangement enables the array of contacts to be closely laterally spaced within the conductor terminating part of the housing to minimize the required width dimension of the connector body 12 so that the modular plug 10 ma be arranged in adjacent side-by-side relationship to other modular plugs of like kind plugged into a multi-plug adapter which comprises an array of closely spaced plug receptacles such as the receptacles **13*a*–13*f*** shown in U.S. patent application of James J. Johnston entitled Interface Connector, Ser. No. 365,855, filed Apr. 5, 1982, owned by the assignee of the present invention, now abandoned, and hereby adopted by reference as part of the present invention.

A generally rectangular metal blade 34 is mounted in and extends transversely of the contact carrier 14 forward of the insulation displacement portions 28,28 and 28',28'. The blade 34 has a rectilinear upper edge 36 which is exposed above the contact carrier 14. The edge 36 is preferably honed smooth but is not sharp, so that accidental contact with the edge when handling the device will not be likely to cause injury.

An upwardly projecting strain relief ridge 40 formed on the contact carrier 14 extends transversely of the contact carrier rearward of the blade 34 and is partially defined by a plurality of longitudinally extending conductor receiving grooves 38,38 formed in the contact carrier 14, as best shown in FIG. 4. The grooves 38,38 are equal in number to the contacts 26,26' and open through the upper surface of the contact carrier. Each groove 38 is longitudinally aligned with an associated insulation displacement portion 28 or 28'. It should be noted that the portions of the conductor receiving grooves located forward of the ridge 40 and indicated at 38',38' are somewhat deeper than the portions of the grooves rearward of the ridge, for a purpose which will be hereinafter further evident.

When the contact carrier 14 is assembled in snap-in relation to the body 12 the blade 34 is disposed generally adjacent the rear surface of the central wall 23. A plurality of upwardly open conductor receiving recesses 42,42 are formed in the central wall 23, as best shown in FIG. 2, for a purpose to be hereinafter further discussed. Each recess 42 is longitudinally aligned with an associated groove 38', 38'.

Figure 7:
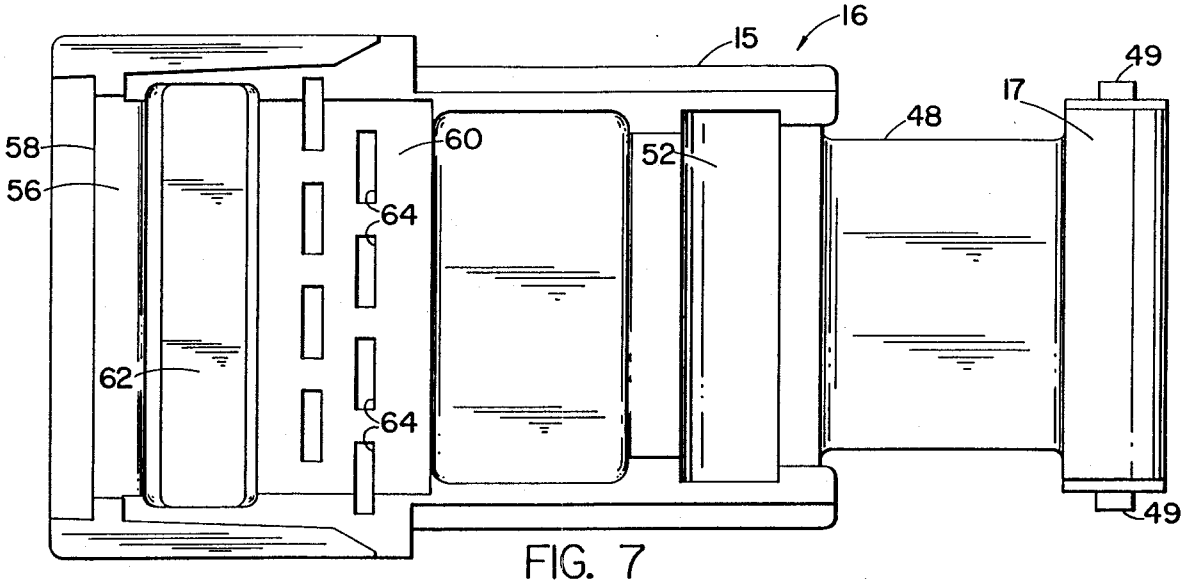
FIG. 7 is a bottom view of the cover assembly.
Figure 8:
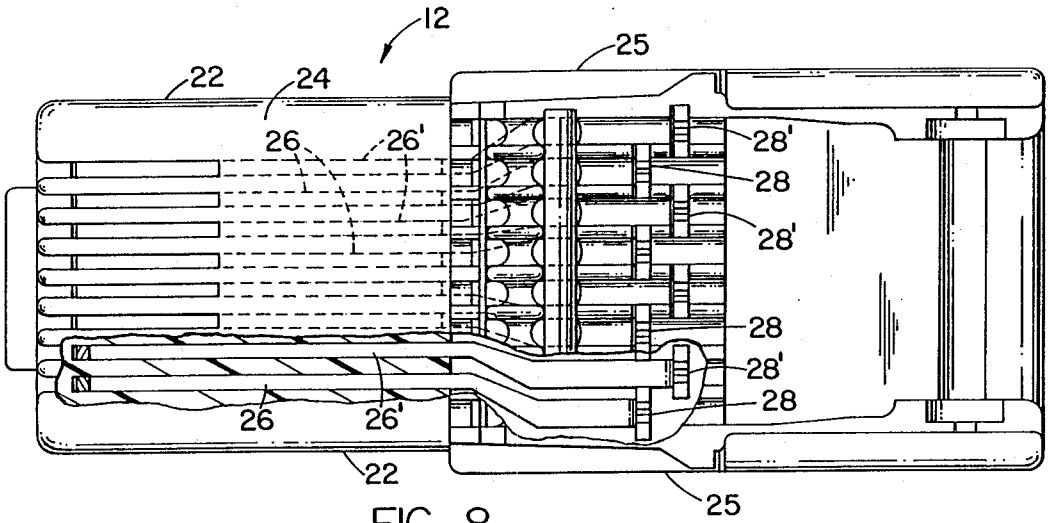
FIG. 8 is similar to FIG. 4 and further illustrates the arrangement of the contacts.

As previously noted the cover asssembly 16 includes the cover 15 adapted for snap-together assembly with the body 12, and the cable strain relief member 17 which is of generally elliptical cross-section and connected to the rear edge of the cover by an elongated flexible strap or living hinge 48. The strain relief member 17 extends between the side walls 25,25, the opposite end portions of the strain relief member being received within generally complementary upwardly and inwardly opening recesses 50,50 formed in the side walls 25,25, best shown in FIG. 4. Latching cams 49,49 project from opposite ends of the strain relief member 17 for cooperating in snap engagement with the lips 29,29 to temporarily secure the cover assembly 16 and an associated cable C in assembly with the body 12 until the cover 15 is assembled with the body. A downwardly open complementary recess 52 in the lower side of the cover 15, shown in FIGS. 6 and 7, receives an upper portion of the cable strain relief member 17 therein when the cover 15 is assembled in snap-in engagement with the body 12 generally inwardly of the side walls 25,25. The strain relief member 17 cooperates with an upwardly open recess 54 in the contact carrier to grip and provide strain relief for the cable C terminated by the modular plug 10.

A shearing member 56 formed on the lower sides of the cover 5 extends transversely thereof to define a transversely extending shearing edge 58 which cooperates in shearing relation with the blade edge 36 when the cover 15 is snapped into assembly with the body 12. A conductor stuffer 60 defined by a portion of the lower surface of the cover 15 extends transversely thereof in rearwardly spaced relation to the shearing member 56 and cooperates with the shearing member to define a downwardly open strain relief recess 62 above the strain relief ridge 40. The lower surface of the conductor stuffer 60 has a plurality of recesses 64,64 opening therethrough for registry with associated insulation displacement portions 28,28 and 28',28' and receives the upper ends of the latter insulation displacement portions when the cover 15 is assembled in snap-in engagement with the body 12.

The contact carrier 14 is preferably permanently assembled with the body 12 during manufacture. However, the cover assembly is intended for assembly with the body 12 in the field when the connector assembly 10 is used to terminate an associated cable.

Preparatory to terminating a cable, such as the cable C, an end portion of the cable insulation jacket is stripped from the cable to expose end portions of the various individually insulated and color coded conductors which comprise the cable. The jacketed end portion of the cable is positioned in overlying relation to the recess 54 in the contact carrier and the strain relief element 17 is snapped into the body 12 with its opposite ends in the recesses 50,50. The latching cams 49,49 cooperate with the lips 29,29 to temporarily secure the cable C and cover assembly 16 in assembly with the body. The color coded conductor free end portions are then fanned out and each conductor end portion is positioned according to color code within of an associated insulation displacement slot 30 or 30' and in parallel alignment with an associated conductor receiving groove 38. The free end portions of the conductors are further arranged to extend for some distance in a forward direction beyond the blade 34, each conductor free end portion being disposed within an associated conductor receiving groove 42 forward of the blade.

The cover 15, secured to the strain relief member, is then aligned with the upper edges of the side walls 22,22 and snapped into engagement with the body 12 by applying pressure, as necessary, to complete cable termination. More specifically, as the cover 15 is pivoted into assembly with the body 12 using the strain relief member 17 as a fulcrum, the shearing edge 58 cooperates in shearing relation with the blade edge 36 to snip-off the excess free end portions of the conductors. The downwardly facing surface o the conductor stuffer 60 simultaneously sets the various conductors in respectively associated insulation displacement slots 30,30 and 30',30' as the insulation displacement portions 28,28 and 28',28' move into the recesses 64,64 formed in the lower side of the cover.

The trimmed forward end portion of each insulated conductor is deflected downwardly and away from the blade 34 by the shearing member 56 and into an associated conductor receiving groove 38' immediately forward of the strain relief ridge 40. The free ends of the conductors are also simultaneously bent over the strain relief ridge 40 to an assembled position, substantially as shown in FIG. 6. The cable strain relief member 17 at the rear end portion of the body is also simultaneously brought into strain relieving engagement with the cable C.

After assembly, the trimmed free end portion of each conductor is disposed within an associated conductor receiving groove portion 38' and is thereby isolated from each of the other trimmed conductor end portions. Further, the shearing member 56 substantially covers the portion of the blade rear surface which is exposed above the contact carrier 14 so that the risk of electrically shorting the conductors against the blade is entirely eliminated.

The snap-in cover 15 is held in assembly with the body inwardly of the side walls 25,25 12 by the hook shaped projections 29,29 on the body which engage associated surfaces on the cover, designated by the numerals 51,51 in FIG. 3. Provision of the cover 15 and strain relief member 17 as a connected assembly reduces the number of separate small parts which must be handled in terminating a cable, thereby reducing risk of part loss during termination.

The arrangement of the blade 34 within the housing virtually eleminates all risk of accidental finger contact with the blade edge during handling. However, should accidental contact occur the relatively dull edge on the blade further assures that no injury is likely to result from such contact.

The width of the plug connector is minimized by minimizing the thickness of the walls 25,25 while maintaining sufficient wall thickness to assure snap-together assembly of the various parts of the resilient connector without risk of permanent set and utilizing a staggered arrangement of the insulation displacement portions within the conductor terminating portion of the housing. The arrangement of the cover for snap assembly with the body inward of the side walls 25,25 also important to the realization of an eight contact modular connector for plugging engagement within a standard FCC modular telephone receptacle and having a minimum width dimension which enables adjacent side-by-side plugging with minimal spacial requirement.

I claim:

1. A field terminable modular connector for terminating an electrical cable having a plurality of insulated electrical conductors and comprising an assembly of connector sections, a plurality of insulation displacement contacts supported by one of said connector sections, stuffing means for setting each of said insulated electrical conductors of a cable to be terminated in insulationed displacing engagement with an associated one of said insulation displacement contacts in response to movement of another of said connector sections into assembled relation with said one connector section, shearing means for trimming free and portions of the insulated conductors in response to movement of said other connector section into assembled relation to said one connector section and including a shearing blade mounted on one of said conductor sections, reflecting means for kinking the trimmed free end portions of said insulated electrical conductors o move the trimmed free ends thereof away from said shearing blade and for gripping and holding the trimmed free end portions of the insulated electrical conductors in spaced relation to said shearing blade and in fixed position relative to said modular connector in response to movement of said other connector section into assembled relation to said one connector section, and cable strain relief means for gripping and holding an associated portion of the electrical cable in fixed position relative to an associated one of said connector sections before said other connector section is moved into assembled relation to said one connector section and including a strain relief member and means for effective snap-together assembly between said strain relief member and said associated one of said connector sections.

2. A field terminable modular connector as set forth in claim 1 wherein said shearing means comprises a shearing member carried by one of said connector sections for cooperating in shearing relation with said blade.

3. A field terminable modular connector as set forth in claim 1 wherein said deflecting means comprises a strain relief ridge on one of said connector sections and a strain relief recess in another of said connector sections for receiving an associated portion of said strain relief ridge therein and said strain relief recess is partially defined by said shearing member.

4. A field terminable modular connector as set forth in claim 1 wherein said stuffing means comprises a conductor stuffer carried by said other connector section and having a stuffing surface for engaging the insulated conductors and defining a plurality of recesses opening through said stuffing surface and equal in number to said insulation displacement contacts, each of said recesses receiving a portion of an associated one of said insulation displacement contacts therein when said other connector section is moved into assembled relation to said one connector section.

5. A field terminable modular connector as set forth in claim 1 wherein said strain relief member is integrally connected to one of said sections by a living hinge.

6. A field terminable modular connector as set forth in claim 1 wherein said connector sections include a body section defining a body cavity, a contact carrier received within said body cavity and retained in assembly therewith, and a cover for snap-together assembly with said body section and said body section comprises said one connector section and said cover comprises said other connector section.

7. A field terminable modular connector as set forth in claim 6 wherein said cable strain relief member is integrally connected to said cover by a living hinge.

8. A field terminable modular connector for terminating an insulated electrical cable containing a plurality of individually insulated electrical conductors and comprising a connector body having a bottom wall, a front wall, a pair of opposing side walls, and a top wall connected to and extending between said side walls and in a rearward direction from said front wall and terminating near a central portion of said connector body, said connector body having a central wall projecting upwardly from the rear end of said top wall and extending laterally between said side walls, portions of said side walls rearward of said central wall extending above said central wall, said walls defining a rearwardly and upwardly open body cavity, said connector body having a series of parallel laterally spaced apart slots opening through said front wall and said top wall and opening into said body cavity, a contact carrier, means for securing said contact carrier in snap-in assembly with said connector body, a blade mounted on said contact carrier and disposed generally adjacent the rear surface of said central wall, said blade having a laterally extending upper edge disposed some distance below the upper edge of said central wall, a laterally spaced apart series of insulation displacement contacts supported by said contact carrier, each of said contacts having an insulation displacement portion including a bifurcated upper end portion projecting above said contact carrier and defining an upwardly open insulation displacement slot, each of said contacts having a contact portion integrally connected to said insulation displacement portion and exposed at an associated one of said slots, a laterally spaced apart series of longitudinally disposed upwardly open conductor receiving grooves, each of said grooves being longitudinally aligned with an associated one of said insulation displacement slots, a strain relief ridge formed on said contact carrier and extending laterally thereof between said blade and said insulation displacement portions, said strain relief ridge partially defining portions of said conductor receiving grooves located between said strain relief ridge and said blade, a cover, means for connecting said cover and said connector body in snap together assembly, shearing means associated with said cover and cooperating with said blade for trimming extending end portions of conductors positioned within said conductor receiving grooves when said cover is snapped into assembly with said body, said cover further including stuffing means for setting conductors positioned within said conductor receiving grooves in said insulation displacement slots when said cover is snapped into assembly with said connector body, said shearing means cooperating with said strain relief ridge to deflect trimmed end portions of conductors received within said conductor receiving grooves away from said blade when said cover is snapped into assembly with said connector body.

9. A field terminable modular connector as set forth in claim 8 wherein said contacts include two groups of contacts arranged in alternate laterally spaced series on said contact carrier, the contacts of one of said groups being of somewhat greater longitudinal extent than the contacts of the other of said groups.

10. A field terminable modular connector as set forth in claim 8 including cable strain relief means for gripping and holding a cable terminated by said modular connector when said cover is snapped into assembly with said connector body.

11. A field terminable modular connector as set forth in claim 10 wherein said cable strain relief means includes a cable strain relief member and said modular connector includes an elongated living hinge connecting said strain relief members to said cover.

12. A field terminable modular connector as set forth in claim 8 including means for retaining said cable strain relief member in a generally predetermined position of assembly with said connector body prior to assembly of said cover with said body.

13. A field terminable connector as set forth in claim 8 wherein said stuffing means is defined by a depending portion of said cover having a stuffing surface and a plurality of stuffing recesses opening through said stuffing surface and equal in number to said contacts for receiving said insulation displacement portions therein when said cover is snapped into assembly with said connector body.

14. A field terminable modular connector comprising a plurality of sections including a body section, a contact carrier received in snap-in assembly within said body section, and a cover for snap-in assembly with said body section, a plurality of insulation displacement contacts mounted in fixed position on said contact carrier, stuffing means associated with said cover for setting insulated conductors into insulation displacing engagement with said contacts in response to movement of said cover into assembly with said body section, shearing means for trimming free end portions of the insulated conductors in spaced relation to said contacts in response to movement of said cover into assembly with said body section, and deflecting means for moving the trimmed free end portions away from shearing means in response to movement of said cover into assembly with said body section.

15. A field terminable modular connector as set forth in claim 14 wherein said contact carrier and said cover cooperate to define conductor strain relief means for gripping and holding a plurality of conductors n fixed position within said connector when said cover is snapped into assembly with said body section.

16. A field terminable modular connector for terminating an electrical cable having a plurality of insulated electrical conductors and comprising an assembly of connector sections, a plurality of insulation displacement contacts supported by one of said connector sections, stuffing means for setting each of the insulated electrical conductors of a cable to be terminated in insulation displacing engagement with an associated one of said insulation displacement contacts in response to movement of another of said connector sections into assembled relation with said one connector section, shearing means for trimming free end portions of the insulated electrical conductors in response to movement of said other connector section into assembled relation with said one connector section and including a shearing blade, means for deflecting the trimmed free end portions of the insulated electrical conductors into and maintaining the trimmed free end portions of the insulated electrical conductors in spaced relation to said shearing blade in response to movement of said other connector section into assembled relation to said one connector section, and cable strain relief means for gripping and holding an associated portion of the electrical cable in fixed position relative to said modular connector including a strain relief member integrally connected in spaced relation to one of said sections comprising said one connector section and said other connector section by a living hinge and positionable between said one connector section and said other connector section for cooperating with said one connector section and said other connector section to grip the associated portion of the cable when said other connector section is moved into assembled relation to said one connector section.

17. A field terminable modular connector as set forth in claim 16 wherein said connector sections include a body and a corner connectable in snap-assembly with said body and said one connector section comprises said body and said other section comprises said cover.

18. A field terminable modular Connector for terminating an electrical cable having a plurality of insulated electrical conductors and comprising a hollow body, a cover, a plurality of insulation displacement contacts supported within said hollow body, said body having a plugging part including front, top, bottom and side walls and being sized to be received in plugging engagement within a standard FCC telephone plug receptacle, and a conductor terminating part integrally connected to and extending rearwardly from said plugging part and having bottom and side walls and an opening at the top thereof, said conductor terminating part, having a lateral width greater than the lateral width of said plugging part, said contacts including two groups of longitudinally rearwardly extending insulation displacement contacts, the contacts of one group being of greater longitudinal extent than the contacts of the other group, the contacts of said two groups being arranged in laterally spaced apart alternate series within said body, each of said contacts having a contact portion contained within and exposed at the forward end of said plugging part, each of said contacts having an insulation displacement portion disposed within said conductor terminating part, the insulation displacement portions of said two groups of contacts being longitudinally staggered within said conductor terminating part, stuffing means for setting each of said insulated electrical conductors in insulation displacing engagement with an associated one of said insulation displacement contacts in response to movement of said cover into assembled relation with said body, shearing means for trimming free end portions of the insulated conductors in response to movement of said cover into assembled relation with said body and including a shearing blade, and means for deflecting the trimmed free end portions of said insulated conductors to and maintaining said trimmed free end portions of said insulated conductors in spaced relation to said shearing blade in response to movement of said cover into assembled relation with said body, said cover in assembly with said body being connected in snap-in engagement with said body between said side walls of said conductor terminating part and forming a closure for said opening.

19. A field terminable modular connector as set forth in claim 18 in the width of said conductor terminating part is substantially equal to the width of said plugging part plus the combined major thickness of the two side walls of said conductor terminating part.

20. A field terminable modular connector for terminating an electrical cable having a plurality of insulated electrical conductors and comprising an assembly of connector sections, a plurality of insulation displacement contacts supported by one of said connector sections, stuffing means for setting each of said insulated electrical conductors in insulation displacing engagement with an associated one of said insulation displacement contacts in response to movement of another of said connector sections into assembled relation with said one connector section, and said cable strain relief means for gripping and holding an associated portion of the electrical cable in fixed position relative to said modular connector including a strain relief member and flexible member in spaced relation to one of said sections comprising said one section and said other connector section and positionable between said one connector section and said other connector section for cooperating with said one connector section and said other connector section when said other connector section is moved into assembled relation to said one connector section.

21. A field terminable modular connector as set forth in claim 20 wherein said flexible connecting means comprises a living hinge.

22. A field terminable modular connector as set forth in claim 20 including means for temporarily securing the electrical cable in assembly with one of said connector sections comprising said one connector section and said other connector section until said one connector section is moved into assembled relation to said other connector section.

23. A field terminable modular connector as set forth in claim 22 wherein said means for temporarily securing the electrical cable comprises means for securing said strain relief member in snap-in assembly with one of said connector sections comprising said one connector section and said other connector section.

24. A field terminable modular connector for terminating an electrical cable having a plurality of insulated electrical conductors and comprising a plurality of connector section including a body, defining a body cavity, a contact carrier received and retained in said body cavity, and a cover for snap together assembly with said body, a plurality of insulation displacement contacts supported by said contact carrier, stuffing means for setting each of said insulated electrical conductors of a cable to be terminated in insulationed displacing engagement with an associated one of said insulation displacement contacts in response to movement of said cover into assembled relation with said body, shearing means for trimming free end portions of the insulated conductors in response to movement of said cover into assembled relation to said body, and including a shearing blade mounted on one of said conductor sections, reflecting means for kinking the trimmed free end portions of said insulated electrical conductors to move the trimmed free ends thereof away from said shearing blade and for gripping and holding the trimmed free end portions of the insulated electrical conductors in spaced relation to said shearing blade and in fixed position relative to said modular connector in response to movement of said cover into assembled relation to said body and a cable strain relief member integrally connected to said cover by a living hinge for positioning between said contact carrier and said cover to be held in fixed position therebetween when said cover is assembled with said body section.

* * * * *